United States Patent [19]

Stuttard

[11] 4,313,247

[45] Feb. 2, 1982

[54] APPARATUS FOR THE MANUFACTURE OF MINERAL INSULATED CABLES

[75] Inventor: Ivan Stuttard, Oldham, England

[73] Assignee: Associated Electrical Industries Limited, London, England

[21] Appl. No.: 116,935

[22] Filed: Jan. 30, 1980

[30] Foreign Application Priority Data

Feb. 8, 1979 [GB] United Kingdom ..... 04409/79

[51] Int. Cl.[3] ..... A05B 3/28

[52] U.S. Cl. ..... 29/33 F; 29/745; 29/825; 29/828

[58] Field of Search ..... 29/745, 825, 828, 875, 29/819, 33 F; 174/102 P

[56] References Cited

U.S. PATENT DOCUMENTS

| | | | |
|---|---|---|---|
| 1,127,281 | 2/1915 | Read | 174/102 P |
| 2,973,572 | 3/1961 | Oakley | 29/745 |
| 3,017,688 | 1/1962 | Cummings | 29/745 X |
| 3,452,434 | 7/1969 | Wagele | 174/102 P |
| 3,553,811 | 1/1971 | Garner | 29/828 X |
| 3,693,250 | 9/1972 | Brorein | 29/745 X |
| 3,737,997 | 6/1973 | Davis | 29/825 |
| 4,212,097 | 7/1980 | Portinari | 29/745 |

FOREIGN PATENT DOCUMENTS

| | | | |
|---|---|---|---|
| 963640 | 3/1975 | Canada | 29/828 |
| 1440781 | 12/1968 | Fed. Rep. of Germany | 29/828 |

*Primary Examiner*—William R. Briggs

*Attorney, Agent, or Firm*—Kirschstein, Kirschstein, Ottinger & Cobrin

[57] ABSTRACT

In apparatus for the manufacture of mineral insulated cable by a continuous process in which the tubular sheath is formed by bending and seam welding travelling metal strip, and insulating powder is fed through a powder delivery tube into the sheath while the latter is travelling vertically downwards, the conductor wires are introduced into the sheath down the outside of the powder delivery tube through guide means which may include, for a wire adjacent to the seam, a tube having an aperture in its wall adjacent to the weld area. Excess heat is removed from the weld area by either a wire or an air gap adjacent to the weld. When the sheath is formed of an oxidizable metal such as copper, means are provided for delivering a continuous stream of rare gas to the underside of the weld area. Various configurations of the powder/wire delivery system are described.

10 Claims, 19 Drawing Figures

Figures 1, 2, 3:
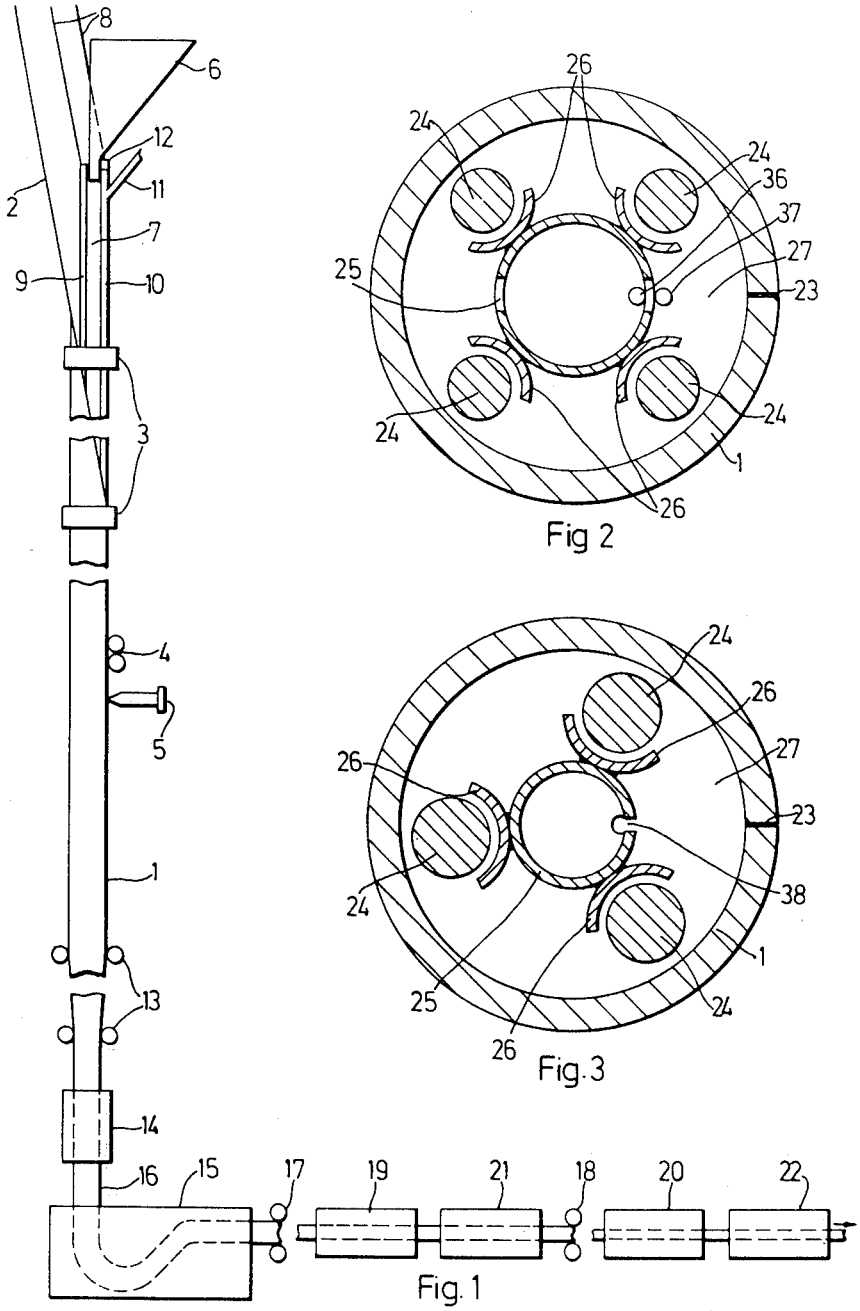

Fig. 8
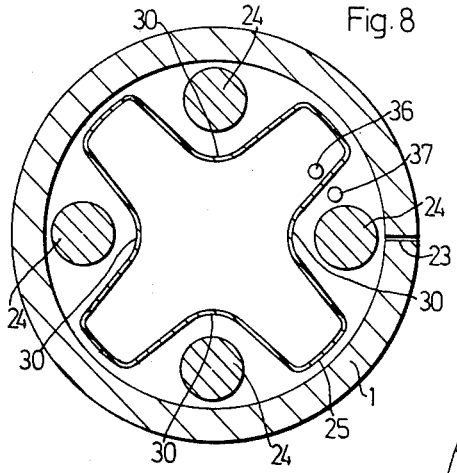
Fig. 9
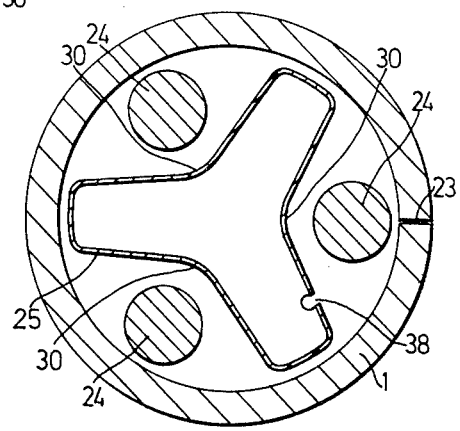
Fig. 10
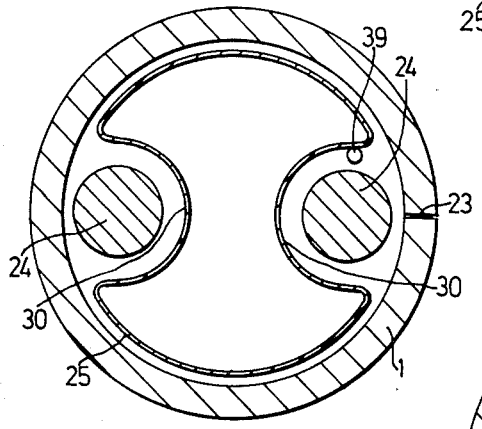
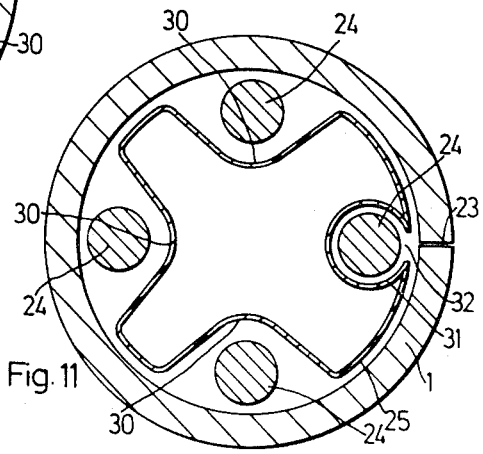
Fig. 11

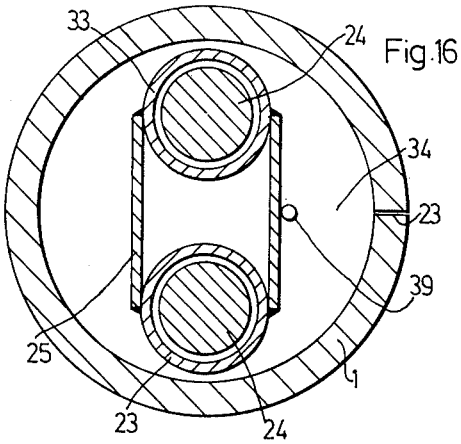
Fig.16
Fig.17
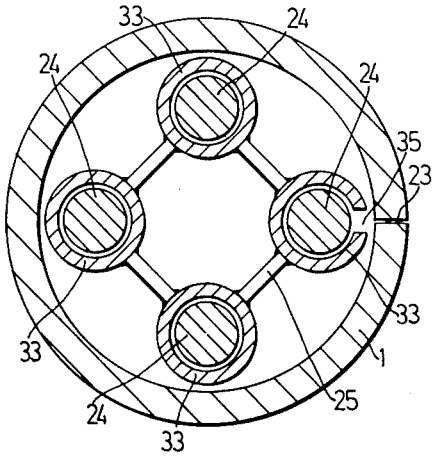
Fig.18
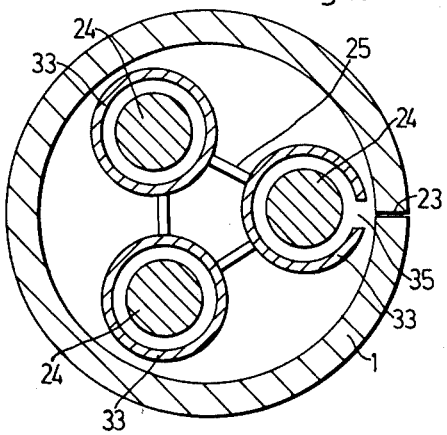
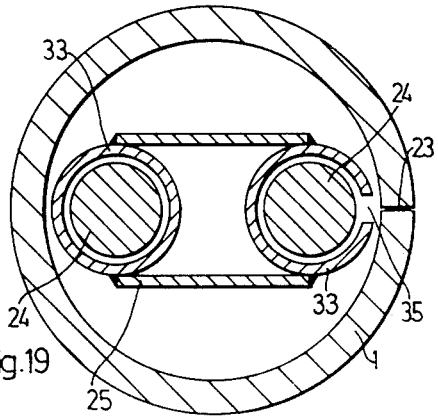
Fig.19

APPARATUS FOR THE MANUFACTURE OF MINERAL INSULATED CABLES

This invention relates to apparatus for the manufacture of mineral insulated electric cables, that is to say cables of the type consisting of one or more electrical conductor wires enclosed within a tubular metal sheath and insulated from the sheath by compacted powdered insulating material, in which the wires are embedded. The term "mineral insulated cables" is to be understood to include, in addition to wiring cables for the conduction of electric current for general purposes, cables of the construction described above and employed for other purposes, for example heating cables, thermocouple cables, and heating elements for electric cookers.

It has been proposed to manufacture mineral insulated cables by a continuous in-line process which comprises continuously forming the sheath from a downwardly travelling strip of ductile metal, for example copper or aluminium, by bending the strip into tubular form and seam welding the abutting edges of the strip together, simultaneously introducing powdered insulating material, such as magnesium oxide, and one or more conductor wires into the sheath so formed, while the sheath is travelling vertically downwards, the powder and the wire or wires being introduced through a powder delivery tube which is disposed within the sheath-forming strip/tube with the outlet end of said delivery tube located below the point at which the seam welding is effected, and passing the resulting assembly through a series of reduction means to compact the insulant powder and to reduce the sheath to the desired overall diameter of the cable. The wire or wires may be introduced into the sheath through a guide tube or tubes disposed within the powder delivery tube.

We have found that, in carrying out the process of the type described above, difficulties arise as a result of the heat generated by the welding procedure. Thus, localised hot spots are liable to develop in the portion of the powder delivery tube adjacent to the welding means, causing damage to the delivery tube, which may result in the release of powder into the region in which the welding is effected (hereinafter referred to as the "weld area"), so damaging the weld. In addition, due to the presence of air on the underside of the seam at the weld point, oxidation of the metal sheath in the welded seam can occur with some metals, especially copper.

It is an object of the present invention to provide improved apparatus for the manufacture of mineral insulated electric cable by a process of the type described above, whereby the above-mentioned difficulties can be reduced or eliminated.

According to the invention, apparatus for the manufacture of mineral insulated electric cable includes means for continuously bending a downwardly travelling strip of ductile metal into the form of a tube and means for seam welding the meeting edges of the bent strip, while the said edges are travelling along a vertically downward path, to form a tubular sheath, a powder delivery tube disposed vertically so as to be located within, and spaced from, the bent strip and formed sheath, and having its outlet end located at a level below that of the welding means, means for feeding powdered insulating material into the said powder delivery tube at a controlled rate, means for feeding one or more continuous lengths of conductor wire vertically downwards, each in a predetermined location along the outside of the powder delivery tube, into the formed sheath, means for guiding the wire or wires into a desired position or positions within the sheath, means for reducing the diameter of the formed sheath, in a plurality of stages, subsequently to the introduction of the insulant powder and the wire or wires into the sheath, and means for annealing and quenching the sheath after each reduction stage, at least the first reduction and annealing means being located vertically below the sheath forming and welding means.

The arrangement whereby the conductor wire or wires is or are fed into the sheath outside the powder delivery tube enables the said tube to be spaced from the path of travel of the seam edges of the sheath tube in the vicinity of the welding means, thus reducing the possibility of overheating of the powder delivery tube by the heat generated in the welding operation. In addition, this arrangement provides means for dissipating excess heat from the weld area, since the location or locations of the wire or wires may be so arranged that there will be an air gap, within the sheath tube, immediately adjacent to the seam edges in the vicinity of the welding means, or alternatively a wire may be located adjacent to the path of travel of the seam edges so as to be directly exposed to the heat generated by the welding operation, excess heat thus being continuously conducted away from the weld area by this wire as it travels downwards into the sheath.

Various configurations of the system for delivering the insulant powder and the wire or wires into the sheath may be employed. In one type of structure, the powder delivery tube is of generally circular or oval cross-section, and one or more guide members for locating each wire individually is or are attached to the external surface of the delivery tube: the guide members are suitably hemi- or part-cylindrical, forming channels for receiving the wires. In a second type of powder/-wire delivery system, the powder delivery tube is formed with one or more external grooves in which the wire or wires are located. A third type of structure includes two or more guide tubes for the wires, spaced apart and formed integrally with the exterior of the powder delivery tube; if this structure is so disposed that one of the guide tubes is located adjacent to the path of travel of the seam edges of the sheath tube, this guide tube is formed with an aperture in the vicinity of the welding means, for exposure of the wire within the tube to heat generated during the welding operation, to enable the excess heat to be dissipated thereby. If desired, in the first type of structure one of the guide members may be in the form of a tube, or in the second type of structure one of the grooves may be closed to form a tube, in each case such a tube being located adjacent to the sheath seam edges and having an aperture for exposure of the wire in the weld area.

Preferably one or more spacer members are provided at or near the lower end of the powder delivery tube, and possibly at one or more additional points in the path of travel of the assembly of wires, to ensure correct positioning of the wire or wires within the sheath. Such a spacer member at the bottom of the powder delivery tube may be so shaped that it will control the flow of the insulant powder into the sheath, so as to ensure correct dispersal and compaction of the powder.

When the sheath is formed of a readily oxidisable metal such as copper, the apparatus also includes means for delivering a continuous stream of rare gas to the interior surface of the bent strip adjacent to the meeting edges thereof in the vicinity of the welding means: this supply of rare gas excludes air from the underside of the weld area and thus prevents oxidation of the sheath metal in the seam. The rare gas employed is suitably argon, but helium, neon, krypton or xenon may be used if desired. The gas may be delivered directly to the weld area through a fine bore tube inserted into the partially formed sheath tube and terminating opposite to the welding means, or the gas may be passed down a tube located inside the powder delivery tube and either emerging through the wall of the powder delivery tube opposite to the weld point, or extending to the bottom of the powder delivery tube and thence up the outside of the powder delivery tube to the weld point. Alternatively, and preferably, where the powder/wire delivery system includes a wire guide tube having an aperture located adjacent to the seam edges in the weld area, the gas is passed through an inlet into this guide tube, the said aperture providing an outlet for the gas, enabling it to flood the weld area. A tube of this form may be employed for delivering the gas even if it is not required to perform the additional function of guiding a wire adjacent to the seam.

Some specific forms of apparatus in accordance with the invention will now be described by way of example with reference to the accompanying diagrammatic drawings, in which FIG. 1 shows, in elevation, an outline of the plant lay-out for the manufacture of a mineral insulated cable by the above-described vertical process, and FIGS. 2 to 19 show cross-sections of various alternative configurations of the arrangement for delivering the insulant powder and conductor wires into the cable sheath, which can be used in the apparatus of FIG. 1, the sections being drawn in the weld area.

Like parts in the different figures of the drawings are indicated by the same reference numerals.

In the apparatus shown in FIG. 1, the arrangement for forming the cable sheath 1 from a metal strip 2 consists of a tube forming machine comprising six opposed pairs of tube forming rolls 3 (only one of each of the first and last pairs of rolls are shown in the drawing), a seam guide 4, and an argon arc welding head 5. The seam guide consists of a series of narrow metal rollers, which are located in the path of travel of the seam edges of the formed tube and are inserted between the edges before they reach the welding head, so as to keep the seam straight and prevent its misalignment with respect to the welding head.

The arrangement for filling the sheath consists of a small internally heated hopper 6 to which insulant powder is supplied from a larger hopper (not shown) at a controlled rate, and a stainless steel powder delivery tube 7 into which the powder is fed from the hopper 6 and which extends into the sheath 1 for a considerable distance below the welding head 5. Conductor wires 8, of which two are shown, are fed into the sheath through guide means 9, 10 attached to the exterior of the powder delivery tube 7. The wire guide means may be of any of the forms shown in FIGS. 2 to 19 of the drawings, but in FIG. 1 one of the guide means, 10, is shown, by way of example only, as a tube provided with an inlet for rare gas at 11, and having a ring seal 12 fitted around the top to prevent back flow of the gas.

The apparatus shown in FIG. 1 further includes means for reducing the diameter of the cable in three stages, consisting of a reduction machine 13 and an annealing furnace 14, both situated vertically below the sheath forming and filling arrangements, a water quenching tank 15 in which the cable 16 is turned in a catenary curve to continue travelling horizontally through two further reduction machines 17, 18, followed respectively by annealing furnaces 19, 20 and water quenching tanks 21, 22. Each reduction machine comprises a number of opposed pairs of reducing rolls, of which only two pairs of the machine 13 and one pair of each of machines 17 and 18, are shown in the drawing.

Before the metal strip 2 is fed through the sheath-forming apparatus described above, its edges are sheared to provide clean, tapered surfaces suitable for welding, and the strip is checked for correct width and edgewise bow, and is degreased. The wires 9 are passed through means (not shown) for straightening, locating and tensioning them, and their surfaces are cleaned, before the wires are introduced into the guides 9, 10. These operations are carried out continuously as the strip and wires travel towards the tube forming and wire guiding apparatus.

Continuous travel of the metal strip and formed sheath and its contents through the system of sheath forming and filling means and reduction, annealing and quenching arrangements, at the desired speed and tension, is effected by conventional pulling and transporting arrangements (not shown), including pinch rolls which follow the final reduction stage, for maintaining continuous tension through the system, and a rotating drum on which the completed cable is finally wound. The rate of delivery of the insulant powder into the sheath is controlled, by weight, in synchronism with the rate of travel of the strip/sheath and wires, to achieve the desired density of powder within the sheath.

Each of FIGS. 2 to 19 of the drawings consists of a cross-section of a powder/wire delivery system, enclosed within the sheath 1, at a point adjacent to the welding head, the seam being shown at 23.

Figure 4:
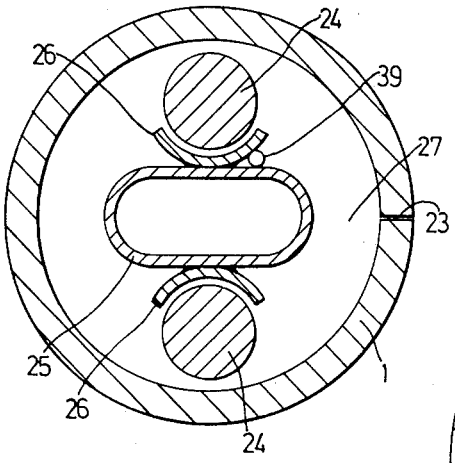
Figure 5:
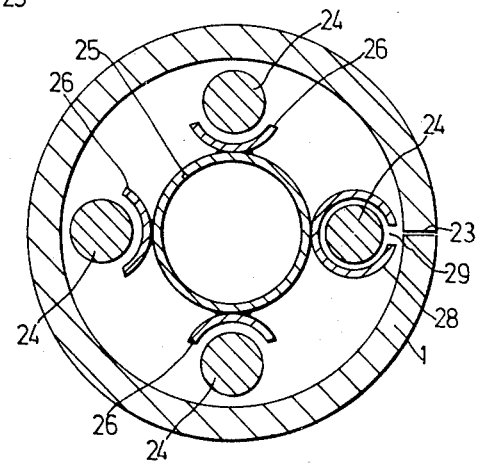
Figure 6:
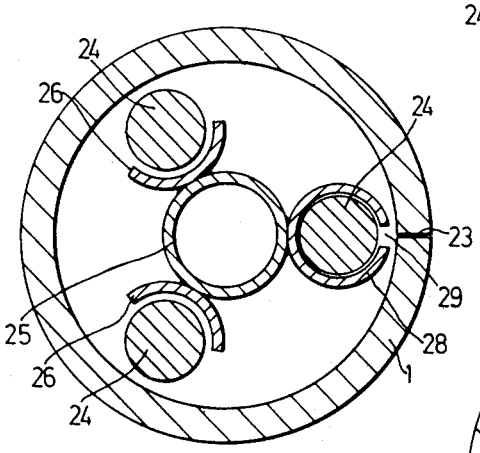
Figure 7:
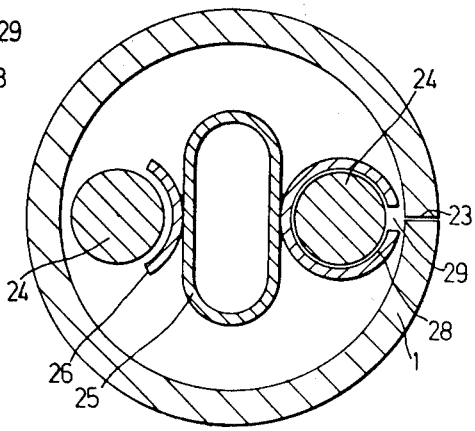
Figure 12:
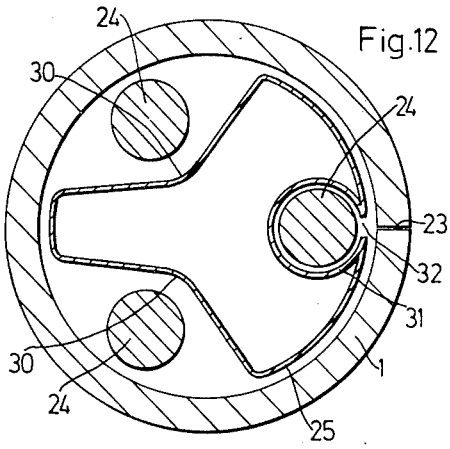
Figure 13:
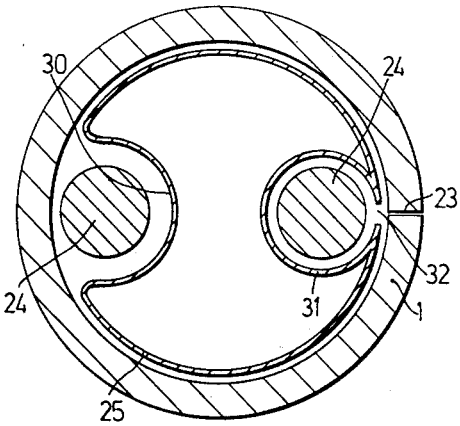

FIGS. 2 and 3 show arrangements for delivering, respectively, four and three conductor wires 24, evenly spaced around the outside of a powder delivery tube 25 of circular cross-section, part-cylindrical guide members 26 being soldered to the exterior surface of the powder delivery tube. FIG. 4 shows a similar arrangement for delivering two wires, the powder delivery tube in this case being of oval cross-section. All these arrangements are so disposed that an air gap 27 between two of the wires occurs adjacent to the sheath seam, providing for dissipation of excess heat from the welding operation. The structures shown in FIGS. 5, 6 and 7 are similar to those of FIGS. 2, 3 and 4 respectively, with the exception that one of the wire guide members is in the form of a tube 28, with a slot 29, and the arrangement is disposed so that the wire in the tube 28 lies opposite to the weld area, the slot 29 being aligned with the seam 23, the said wire thus being exposed to the heat from the weld area.

In each of the delivery structures shown in FIGS. 8, 9 and 10, for four, three and two wires respectively, the powder delivery tube 25 is formed with external grooves 30 for accommodating the wires individually. In each case the disposition of the structure is such that one of the wires lies adjacent to the sheath seam edges 23, for conducting excess heat away from the weld area. A preferred modification of this type of structure is shown in each of FIGS. 11, 12 and 13, in which one of the grooves is closed to form a tube 31 with a slot 32 adjacent to the weld area, to expose the wire in the tube to the heat.

Figure 14:
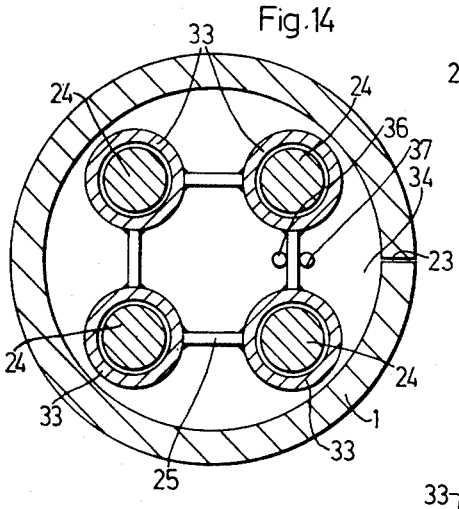
Figure 15:
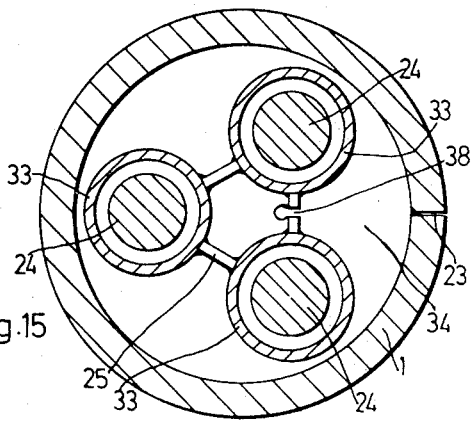

In the structures shown in FIGS. 14 to 19 inclusive, all the wire guide members consist of tubes 33, integral with the powder delivery tube 25. In FIGS. 14, 15 and 16 these structures are so disposed that an air gap 34 is immediately adjacent to the weld area, and in FIGS. 17, 18 and 19 the structures have been rotated so that one of the tubes 33 lies adjacent to the sheath seam and weld area, this tube having a slot 35 for exposure of the wire within the tube.

When any of the delivery arrangements shown in FIGS. 5, 6, 7, 11, 12, 13, 17, 18 and 19 is used, the slotted wire guide tube can be employed for delivering rare gas to the weld area, the tube being provided with an inlet for the gas (as shown at 11 in FIG. 1), and the slot serving as the gas outlet. In the arrangements of FIGS. 2, 3, 4, 8, 9, 10, 14, 15 and 16, in which slotted wire guide tubes are not used, other means for supplying a gas stream to the underside of the weld area must be provided. Examples of three suitable gas supply arrangements are shown in these Figures: it will be understood that these three types of arrangements are interchangeable between the different forms of delivery system shown in the Figures. In the arrangement shown in FIGS. 2, 8 and 14, the gas supply tube 36 passes down inside the powder delivery tube 25, then up the outside of the tube, terminating at 37. In FIGS. 3, 9 and 15 the gas supply tube is again located inside the powder delivery tube, but has an outlet 38 through the wall of the powder delivery tube, opposite to the weld point. In FIGS. 4, 10 and 16 the gas supply tube 39 is shown attached to the outside of the powder delivery tube: the outlet may be at any suitable point in the vicinity of the weld.

In a specific example of a process for the manufacture of mineral insulated cable, using the apparatus described with reference to FIG. 1 and including any one of the powder/wire delivery arrangements shown in FIGS. 2 to 19, for the manufacture of a cable consisting of a copper sheath with copper conductor wires and magnesium oxide as the insulant powder, copper strip 65 mm wide is formed into a tubular sheath initially 20 mm in external diameter. In the first, second and third reduction stages respectively the cable diameter is reduced to 16 mm, 10 mm, and finally 5.7 mm. The rate of travel of the components and cable through the system is initially two meters per minute, being increased after each reduction, and magnesium oxide powder is supplied to the hopper 6 at the rate of 0.99 Kg per minute.

I claim:

1. Apparatus for the manufacture of mineral insulated electric cable which includes means for continuously bending a downwardly travelling strip of ductile metal into the form of a tube and means for seam welding the meeting edges of the bent strip, while the said edges are travelling along a vertically downward path, to form a tubular sheath, a powder delivery tube disposed vertically so as to be located within, and spaced from, the bent strip and formed sheath, and having its outlet end located at a level below that of the welding means, means for feeding powdered insulating material into the said powder delivery tube at a controlled rate, means for feeding at least one continuous length of conductor wire into the formed sheath, means for guiding each said wire into a desired position within the sheath, means for reducing the diameter of the formed sheath, in a plurality of stages, subsequently to the introduction of the insulant powder and each wire into the sheath, and means for annealing and quenching the sheath after each reduction stage, at least the first reduction and annealing means being located vertically below the sheath forming and welding means, wherein the said conductor wire feeding means is arranged to feed each length of wire vertically downwards in a predetermined location along the outside of the powder delivery tube, and the said means for guiding each said wire into a desired position within the sheath is located along the exterior of the powder delivery tube.

2. Apparatus according to claim 1, wherein the said wire feeding and guiding means are arranged to locate each said wire so that there will be an air gap, within the sheath tube, immediately adjacent to the seam edges in the vicinity of the welding means, to enable excess heat to be dissipated.

3. Apparatus according to claim 1, wherein the said wire feeding and guiding means are so arranged that the location of one wire is adjacent to the path of travel of the seam edges, so that the said wire is directly exposed to heat generated by the welding operation, to enable excess heat to be dissipated.

4. Apparatus according to claim 1, wherein the powder delivery tube is of generally circular or oval cross-section, and a guide member of part-cylindrical form for locating each wire individually is attached to the external surface of the powder delivery tube.

5. Apparatus according to claim 1, wherein the powder delivery tube is formed with an external groove for locating each wire.

6. Apparatus according to claim 1, wherein at least two guide tubes for individual wires are provided, said guide tubes being spaced apart and formed integrally with the exterior of the powder delivery tube.

7. Apparatus according to claim 1, wherein guide means are provided for each individual wire on the exterior of the powder delivery tube, and one such guide means is a tube located adjacent to the path of travel of the seam edges of the sheath and formed with an aperture in the vicinity of the welding means, for exposure of the wire within the said guide tube to heat generated during the welding operation to enable excess heat to be dissipated.

8. Apparatus according to claim 1, wherein at least one spacer member is provided, at least in the vicinity of the lower end of the powder delivery tube, for ensuring correct positioning of each wire within the sheath.

9. Apparatus according to claim 1 which also includes means for delivering a continuous stream of rare gas to the interior surface of the bent metal strip adjacent to the meeting edges thereof in the vicinity of the welding means.

10. Apparatus according to claim 9, wherein a wire guide tube having an aperture in the vicinity of the welding means is provided, and the said gas delivery means consists of an inlet into the said guide tube, the said aperture providing an outlet for the gas.

* * * * *